US009562405B2

(12) United States Patent
Carpenter

(10) Patent No.: US 9,562,405 B2
(45) Date of Patent: Feb. 7, 2017

(54) METHOD AND APPARATUS FOR CONTINUOUS RAISING AND LOWERING JOINTS OF PIPE

(71) Applicant: William Thomas Carpenter, Houston, TX (US)

(72) Inventor: William Thomas Carpenter, Houston, TX (US)

( * ) Notice: Subject to any disclaimer, the term of this patent is extended or adjusted under 35 U.S.C. 154(b) by 253 days.

(21) Appl. No.: 14/274,748

(22) Filed: May 11, 2014

(65) Prior Publication Data

US 2015/0322736 A1 Nov. 12, 2015

(51) Int. Cl.

| | |
|---|---|
| ***E21B 19/16*** | (2006.01) |
| ***E21B 19/08*** | (2006.01) |
| ***E21B 19/00*** | (2006.01) |

(52) U.S. Cl.

CPC ..... *E21B 19/16* (2013.01); *E21B 19/00* (2013.01); *E21B 19/08* (2013.01)

(58) Field of Classification Search

CPC ..... E21B 19/08; E21B 19/20

See application file for complete search history.

(56) References Cited

U.S. PATENT DOCUMENTS

| | | | | |
|---|---|---|---|---|
| 2,999,605 A * | 9/1961 | De Jarnett | E21B 19/155 | 414/22.55 |
| 3,083,842 A * | 4/1963 | Bauer | E21B 19/15 | 414/22.61 |
| 3,870,109 A * | 3/1975 | Gray | E21B 3/02 | 173/159 |
| 3,960,360 A * | 6/1976 | Elliston | E21B 15/00 | 166/77.4 |
| 4,139,891 A * | 2/1979 | Sheldon | E21B 19/08 | 340/666 |
| 5,584,351 A * | 12/1996 | Ellicott | E21B 7/046 | 175/52 |
| 2011/0074165 A1* | 3/2011 | Grimes | E21B 3/02 | 290/40 C |

* cited by examiner

*Primary Examiner* — Shane Bomar

(74) *Attorney, Agent, or Firm* — Douglas Baldwin

(57) ABSTRACT

A method and apparatus for lifting and lowering of pipe continuously, during the drilling, repair or maintenance of wells, without interruption to connect or disconnect pipe.

16 Claims, 7 Drawing Sheets

METHOD AND APPARATUS FOR CONTINUOUS RAISING AND LOWERING JOINTS OF PIPE

BACKGROUND OF THE INVENTION

This invention is in the field of drilling, repair or maintenance of wells.

In the drilling, repair or maintenance of wells, particularly oil and gas wells, pipe is raised and lowered by cables mounted on derricks. A pipe or pipes may be lifted singly to be introduced into the wellbore, or a pipe or pipes may be lifted singly to be removed from the wellbore. Pipes may be connected n stands, consisting of two or more joints, and be lifted to be introduced to the well bore or lifted to be removed from the well bore, for example, during a tripping operation, where all of the pipe is removed from the well and then reinstalled back into the well, to replace, modify, maintain or repair some or all of, for example, the bottom hole assembly which may include several tools known to those skilled in the art, during which pipe may be removed, replaced or reinstalled. The pipe may be lowered either gradually, as during drilling, or may be lowered or raised more quickly during, for example, a tripping operation.

A deficiency in the raising and lowering of pipe in the operation of drilling, repair or maintenance of wells is the necessity to interrupt the raising or lowering operation in order to connect or disconnect pipe while removing or installing pipe, for example, during a tripping operation.

SUMMARY OF THE INVENTION

It is an object of the present invention to increase the efficiency of the raising and lowering of pipe during the drilling, repair or maintenance of wells.

It is a further object of the present invention to reduce the interruption of raising or lowering pipe in order to connect or disconnect pipe while removing or installing pipe.

It is a further object of the present invention to protect the well bore from being surged or swabbed when raising or lowering pipe by maintaining a continual selected desired uniform speed of installing or withdrawing pipe.

It is a further object of the present invention to protect the potential commercial viability of formations that were penetrated during the drilling operation.

It is a further object of the present invention to minimize loss of pressure control of formations that were penetrated during the drilling operation.

It is a further object of the present invention to increase the safety of these operations to drill, repair or maintain wells by automation and the reduction of labor.

It is a further object of the present invention to reduce the energy requirements used to power an apparatus that raises and lowers pipe during the drilling, repair or maintenance of wells.

It is a further object of the present invention to reduce the time and cost of rigging down, transporting and rigging up an apparatus that raises and lowers pipe during the drilling, repair or maintenance of wells.

It is a further object of the present invention to reduce the surface equipment to drill, repair or maintain wells.

The apparatus may further comprise means for storage or simultaneous use of power created from the automation of the operation to drill, repair or maintain wells.

To achieve the foregoing objects, there is disclosed an apparatus for continually, without interruption, raising and lowering pipe consisting of systems that alternately lift or lower the pipe with mechanisms that, carry, hold and rotate pipe to connect or disconnect it while it is simultaneously being raised or lowered. The lifting system method may be comprised of piston and cylinder, lead screw, rack and pinion, cable and drum or any other method of raising or lowering pipe.

There is also disclosed a method of continually lifting, lowering or rotating pipe, for example while circulating in a drilling operation, comprising the steps of connecting a circulating device while lowering, raising or rotating a pipe, removing same and reconnecting a secondary circulating device, while continuing to lower, raise or rotate pipe.

BRIEF DESCRIPTION OF THE DRAWINGS

The following Drawings illustrate the invention by pictorially identifying the various stages of the processes and identify their components numerically using the preferred embodiment as an example.

DETAILED DESCRIPTION OF THE INVENTION AND THE PREFERRED EMBODIMENT

Figure 1:
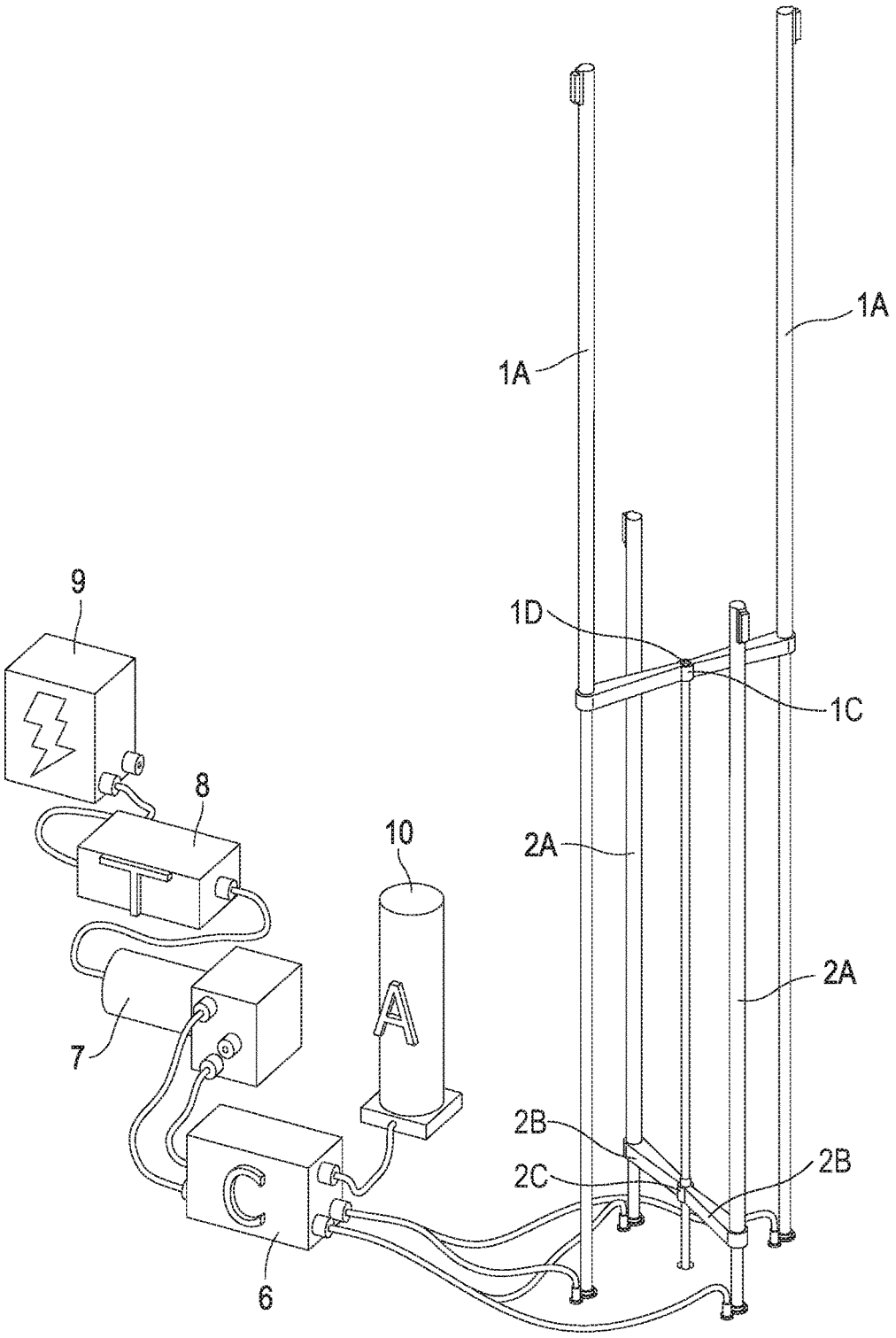
FIG. 1 shows pipe as it was withdrawn by the lifting or lowering device 1A and has just been engaged by the lifting or lowering device 2A in preparation for transferring the load of the pipe and disconnecting the upper pipe.
Figure 2:
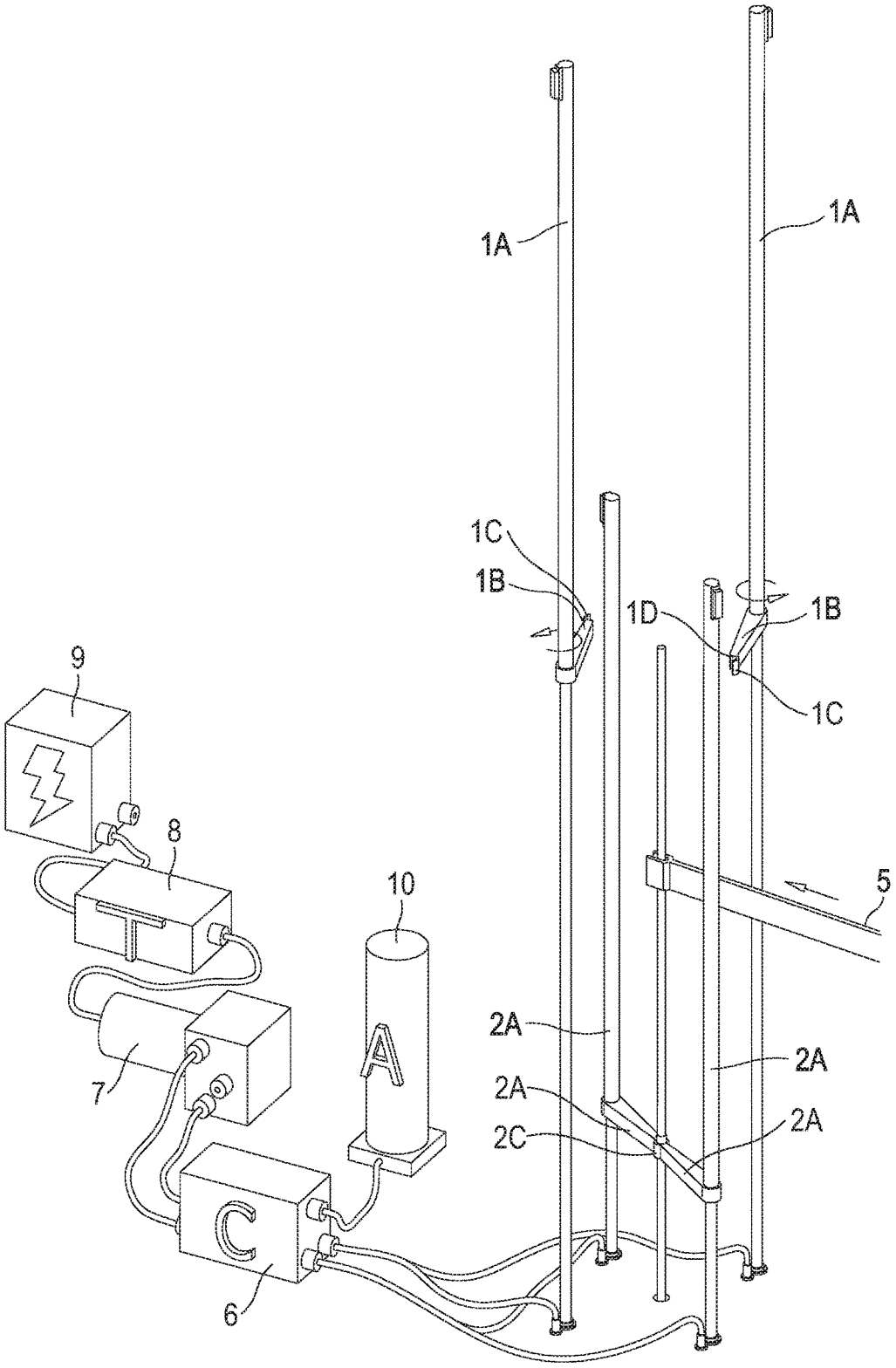
FIG. 2 shows the upper pipe has been disconnected and about to be removed by transfer arm 5 while lifting or lowering device 2A has taken over the process and continues to lift the pipe while the rotating carriers 1B contained in lifting or lowering device 1A have rotated so as to facilitate their passing the other rotating carriers on its way down.
Figure 3:
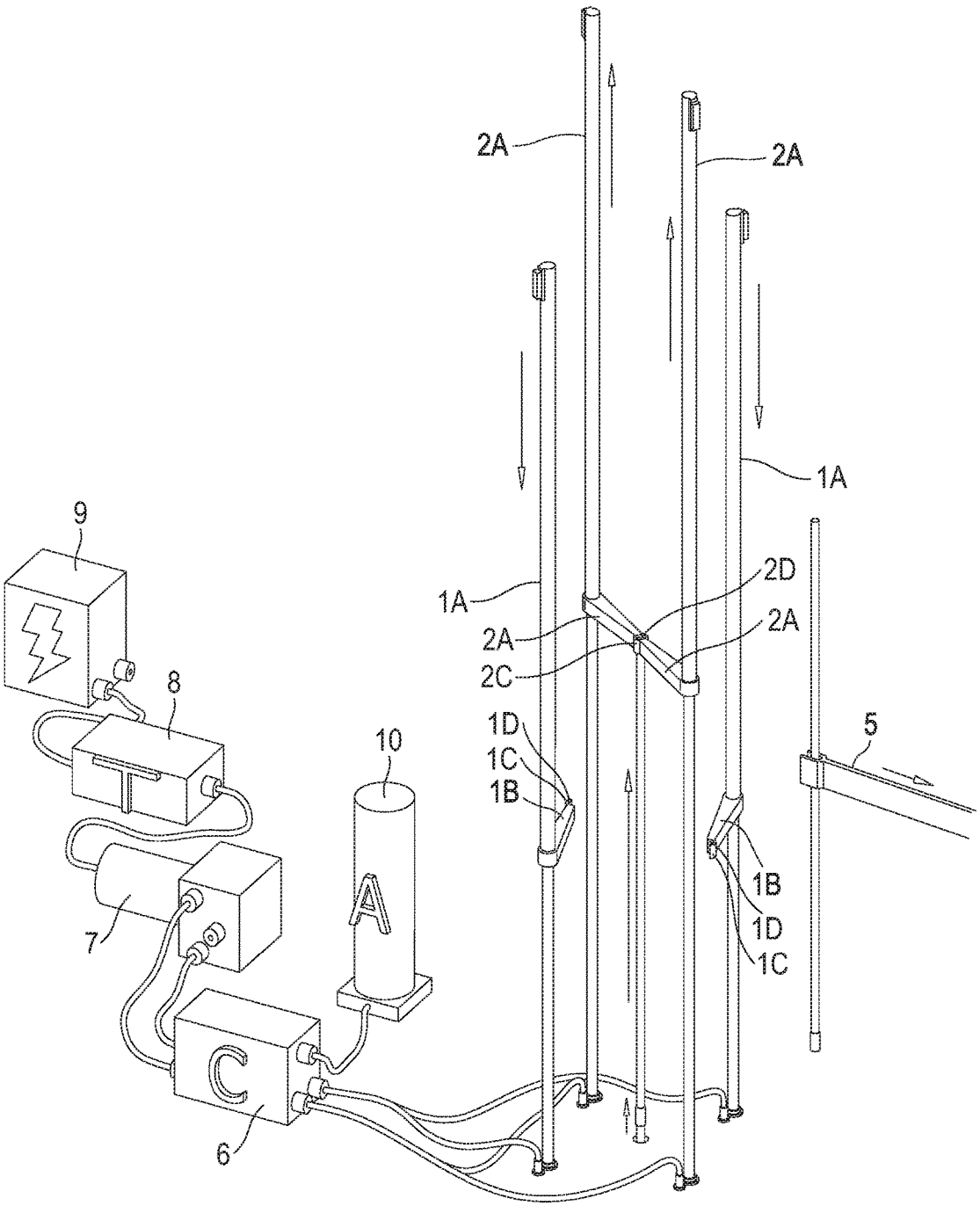
FIG. 3 shows the lifting or lowering device 2A continuing its upward travel while the 1B rotating carriers have passed on their way down and the transfer arm 5 removing the disconnected pipe.
Figure 4:
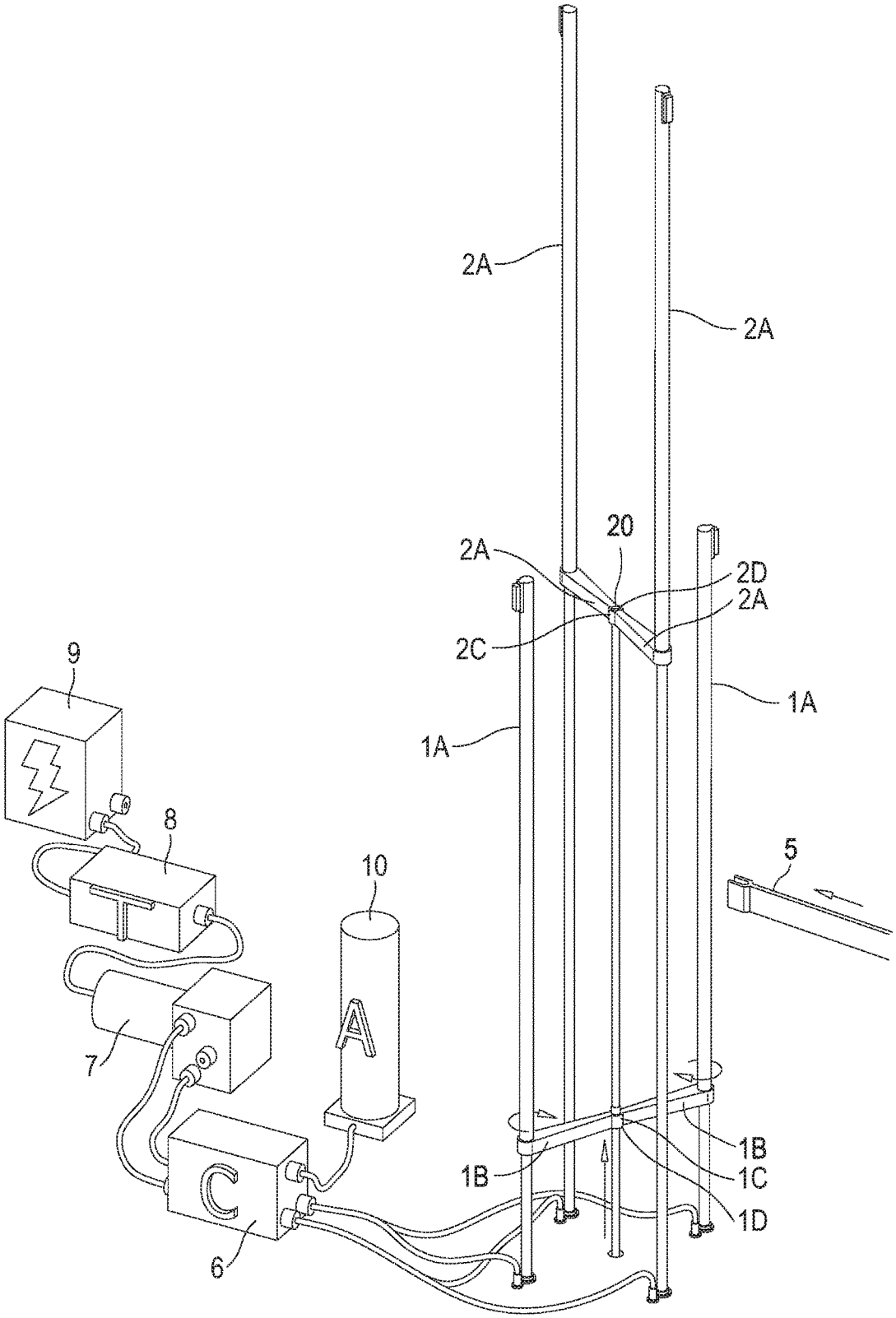
FIG. 4 shows the rotating carrier 1B has now rotated to engage and is lifting the next pipe while the upper pipe is being disconnected by 2D rotating device and transfer arm 5 is preparing to engage the upper pipe when it becomes disconnected.
Figure 5:
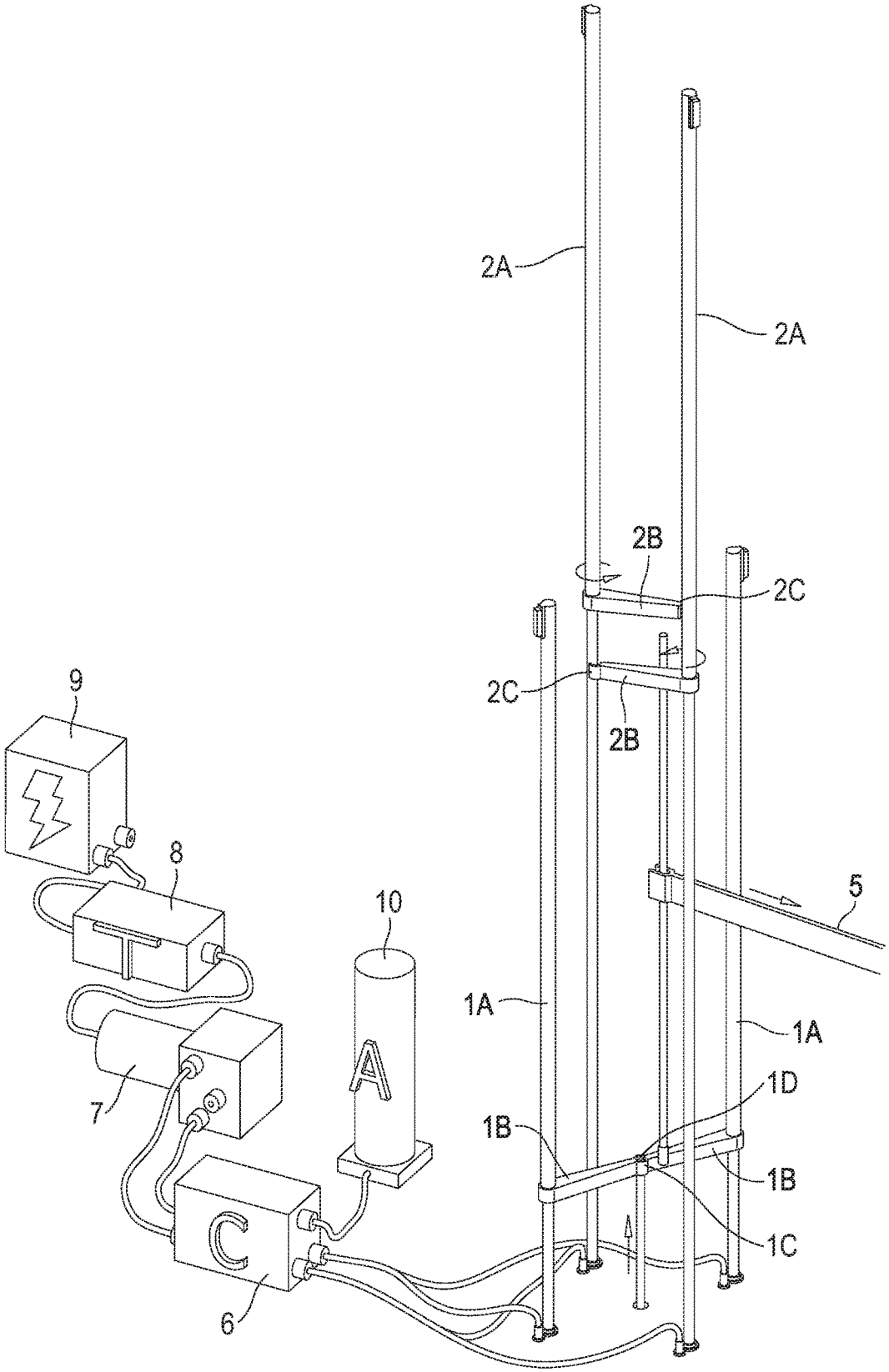
FIG. 5 shows that the carriers 2B have been disengaged and are rotating in preparation for their downward travel so as to pass the 1B carriers that have engaged as the 1A lifting or lowering device are lifting the next pipe as the transfer arm 5 removes the second disconnected pipe.
Figure 6:
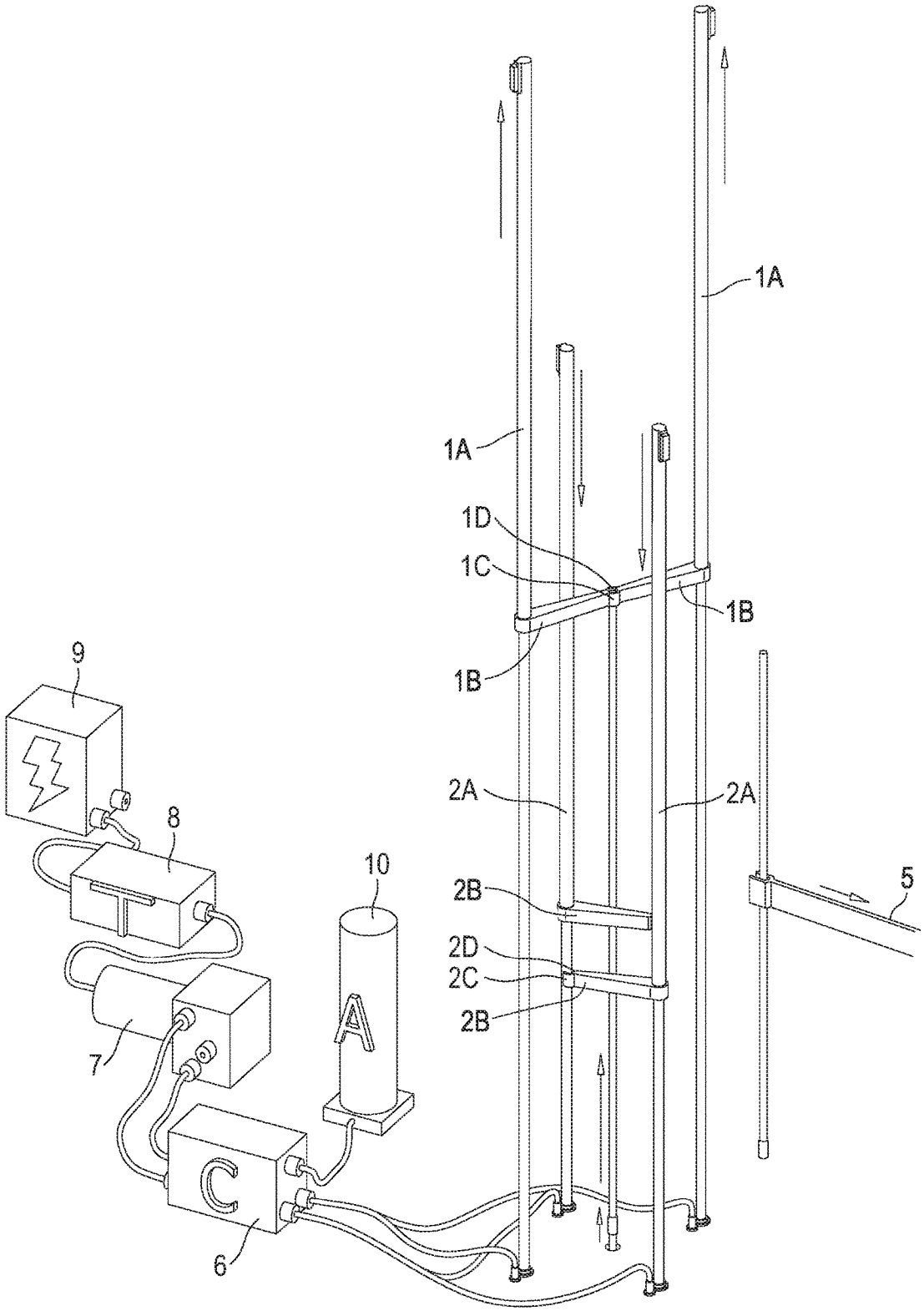
FIG. 6 shows the lifting or lowering device 1A continuing to lift the third pipe, the rotating carriers 2B have rotated and passed the 1B rotating carriers while the transfer arm 5 removes the third pipe. The fourth pipe is shown to be emerging from the well and will shortly be engaged by the rotating carriers 2B to be lifted next by the 2A lifting and lowering device.
Figure 7:
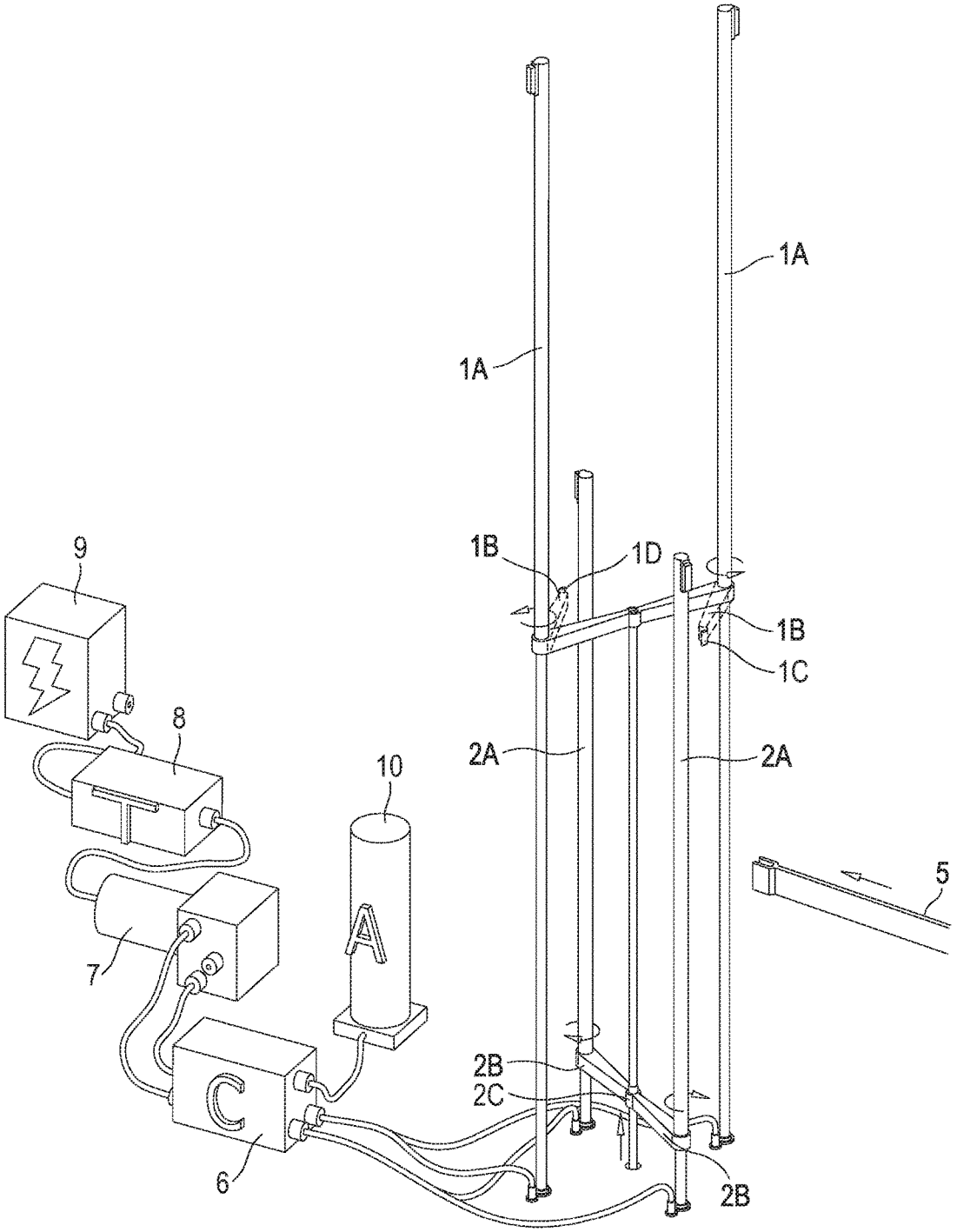
FIG. 7 shows the rotation of carrier arms 1B and 2B to facilitate their passing each other either up or down when lifting and lowering devices 1A and 2A may be lifting or lowering pipe.

FIGS. 1-7 depict various stages of the preferred embodiment of the claimed invention. Throughout the figures, like parts are assigned like numbers. This series of stages give perspective views of an apparatus used during the drilling, repair or maintenance of a well.

Lifting or lowering device 1A raises or lowers pipe and contains the pivoting carrier 1B that contains the holding 1C and rotating 1D sections of the pivoting carrier 1A. The alternative lifting or lowering device 2A alternatively raises or lowers pipe and contains the alternate pivoting carrier 2B that contains the alternate holding 2C and alternate rotating 2D sections of the pivoting carrier 2B. Both the pivoting carrier 1B, and the alternative pivoting carrier 2B, alternatively pivot to facilitate passing each other while traveling either up or down. A transfer arm 5 may remove or introduce pipe as determined by the controller 6. A reversible hydraulic pump 7 connected by transmission 8 to power source 9 may pump hydraulic fluid from a hydraulic fluid reservoir into an accumulator 10. The accumulator may comprise a hydraulic section, a gas section, hydraulic fluid or gas. A means may be incorporated to compress the gas section by the hydraulic section thus storing potential energy in the accumulator. Or in the alternative, valves operated either manually or by a controller 6, may direct hydraulic fluid from one lifting or lowering device 1A, that may be comprised of a hydraulic piston and hydraulic cylinder containing the pivoting carrier 1B that contains the holding 1C and rotating 1D sections of the pivoting carrier 1B, directly to the alternate lifting or lowering device 2A, that may be comprised of a hydraulic piston and hydraulic cylinder containing the pivoting carrier 2B that contains the holding 2C and rotating 2D sections of the pivoting carrier 2B, to provide energy to the lifting or lowering device 2A that contains the pivoting carrier 2B which contains the holding 2C and rotating 2D sections of the carrier 2B.

The lifting or lowering device 1A alternatively raises or lowers pipe and contains the pivoting carrier 1B that contains the holding 1C and rotating 1D sections of the pivoting carrier 1B. The alternative lifting or lowering device 2A that alternatively raises or lowers pipe and contains the pivoting carrier 2B that contains the holding 2C and rotating 2D sections of the pivoting carrier 2B. Both the pivoting carriers 2A and 2B alternatively pivot to facilitate passing each other while traveling either up or down.

The controller 6 may route the hydraulic fluid from either lifting, lowering or rotating device such as 1A to the other lowering, lifting or rotating device such as 1B to assist in lifting or lowering pipe through series of valves. Hydraulic fluid may be pumped by the reversible hydraulic pump 7 through the transmission 8 from either the hydraulic fluid reservoir or hydraulic fluid from hydraulic fluid section powered by expanding gas from the accumulator 10 converting its potential energy to kinetic energy by driving hydraulic fluid through valves, as directed by controller 6, or manually to power or assist in the operation of either lifting or lowering device 1A or 2A and their respective pivoting carriers 1B and 2B, the operation of their respective holding sections 1C or 2C and the operation of their respective rotating sections 1D or 2D. The lifting and lowering devices 1A and 2A, the operation of the pivoting arms 1B and 2B, the operation of the holding devices 1C and 2C and the rotating devices 1D and 2D are controlled by the controller 6 by means of valves in accordance with a protocol established by one skilled in the art. Or alternatively such engaging, disengaging or reversing may be done manually with valves. A transfer arm 5 may remove or introduce pipe as determined by controller 6.

Compressed Air Alternative Embodiment of the Claimed Invention

A compressor connected by transmission 8 to power source 9 can compress air from a filter into an accumulator thus storing potential energy in the accumulator 10 to power the lifting or lowering devices 1A and 2A. Or in the alternative, valves operated either manually or by a controller 6, may direct air from one lifting or lowering device 1A that may be comprised of a piston and cylinder containing the pivoting carrier 1B that contains the holding 1C and rotating 1D sections of the pivoting carrier 1B directly to the alternate lifting or lowering device 2A that may be comprised of a piston and cylinder to provide energy to the lifting or lowering device 2A containing pivoting carrier 2B that contains the holding 2C and rotating 2D sections of the pivoting carrier 2B.

The lifting, lowering or rotating device 1A alternatively raises or lowers pipe and contains the pivoting carrier 1B which contains the holding 1C and rotating 1D sections of the pivoting carrier 1B. The alternative lifting or lowering device 2A that alternatively raises or lowers pipe contains the pivoting carrier 2B that contains the holding 2C and rotating 2D sections of the pivoting carrier 2B. Both the pivoting carriers 1B and 2B alternatively pivot to facilitate passing each other while traveling either up or down.

The controller 6 may route the air from either lifting, lowering or rotating device such as 1A to the other alternate lowering lifting or rotating device such as 2A to assist in lifting or lowering pipe through a series of valves. Air may be pumped by the compressor through the transmission 8 from either the filter or accumulator 10 converting its potential energy to kinetic energy through valves, as directed by controller 6, or manually to power or assist in the operation of either lifting or lowering or device 1A or 2A or their respective pivoting carriers 1B or 2B, the operation of their respective holding sections 1C or 2C and their respective rotating sections 1D or 2D. The lifting and lowering devices 1A and 2A, the operation of the pivoting carriers 1B and 2B, the operation of the holding device 1C and 2C and the rotating device 1D and 2D are controlled by the controller 6 by means of valves in accordance with a protocol established by one skilled in the art. Or alternatively such engaging, disengaging or reversing may be done manually with valves. A transfer arm 5 may remove or introduce pipe as determined by controller 6. The apparatus may be automated as illustrated in FIGS. 1-7.

Lead Screw Alternative Embodiment of the Claimed Invention.

Lifting, lowering or rotating device 1A that contains pivoting carrier 1B contains holding 1C rotating sections 1D is operated by a lead screw powered by a motor. Alternate lifting, lowering and device 2A that contains pivoting carrier 2B contains alternate holding 2C and alternate rotating section 2D is operated by a lead screw powered by a motor while energy captured by the lowering of either lifting or lowering device may assist the raising of the other lifting or lowering device as directed by controller 6. A transfer arm 5 may remove or introduce pipe as determined by the controller 6. The 1B, 1C and 1D devices and the alternative 2B, 2C and 2D devices are powered by motors through the controller 6. The apparatus may be automated as illustrated in FIGS. 1-7.

Rack and Pinion Alternative Embodiment of the Claimed Invention.

Lifting or lowering device 1A that contains pivoting carrier 1B and contains holding 1C and rotating section 1D is operated by rack and pinion powered by a motor. Alternate lifting, lowering and rotating device 2A contains pivoting carrier 2B and contains holding 2C and rotating sections 2D is operated by rack and pinion powered by motor. While energy captured by the lowering of either lifting, lowering device assists the raising of the other lifting or lowering device as directed by controller 6. A transfer arm 5 may remove or introduce pipe as determined by controller 6. The 1B, 1C and 1D devices and the 2B, 2C and 2D devices are operated by motors. This apparatus may be automated as illustrated in FIGS. 1-7.

Drum and Cable Alternative Embodiment of the Claimed Invention.

Lifting or lowering device 1A that contains pivoting carrier 1B and contains holding 1C and rotating sections 1D is operated by a drum and cable powered by a motor. The alternative lifting, lowering and rotating device 2A that contains the pivoting carrier 2B and contains holding 2C section and the rotating section 2D is operated by drum and cable powered by motor. While energy captured by the lowering of either lifting lowering devices assists the raising of the other lifting or lowering device. The transfer arm 5 removes or introduces pipe as determined by controller 6. The 1B, 1C and 1D devices and the 2B, 2C and 2D devices are operated by motors. This apparatus may be automated as illustrated in FIGS. 1-7.

It will be readily apparent to those skilled in the art that many variations of the invention may be employed without deviating from the scope of the claims. For example, any reversible energy storage means may be employed in the invention, including, without limitation, counterweights, springs, batteries, and accumulators. The accumulators may be any type known to those skilled in the art, including, without limitation, gas accumulators. The hydraulic fluid may be any suitable type, such as oil, water, or a mixture thereof. A hydromatic or electric brake may be utilized to capture energy. The centrifugal or piston-actuated drive may be employed to pump air, water, or oil. The energy storage and releasing means may be engaged permanently, manually, or automatically. If the energy storage and releasing means is automated, any control mechanism apparent to those skilled in the art may be used.

Many configurations of the invention within the scope of the claims, but not illustrated in the drawings, will be readily apparent to those skilled in the art having the benefit of this disclosure.

The invention claimed is:

1. A system for continuously raising and lowering joints or stands of pipe, comprising: at least two lifting and lowering device pairs, each having a top section and bottom section and which are vertically disposed beside a well bore; a holding device and a rotating device connected to the top section of each lifting and lowering device; a power source to actuate the lifting and lowering devices, a pivoting device, the holding device and the rotating device connected to each lifting and lowering device; a transfer device to remove or introduce pipe; and means to transfer power to the above devices; and an energy storage means.

2. The system of claim 1 comprising means for converting kinetic energy from the storage means to potential energy in the energy storage means; and means for converting potential energy from the energy storage means to kinetic energy to power the lifting and lowering device(s); the pivoting device(s); the holding device(s); the rotating device(s) and other associated devices.

3. The system of claim 1 in which the energy storage means is a hydraulic or pneumatic accumulator, a spring or a battery.

4. The system of claim 1 in which each of the lifting and lowering devices comprise a hydraulic cylinder and piston.

5. The system of claim 2 in which the means for converting kinetic energy from the storage means to potential energy comprises transfer of hydraulic fluid from a storage means to the cylinder of a lifting and lowering device and transfer hydraulic from a lifting and lowering devices to the said storage means.

6. The system of claim 2 further comprising means for alternatingly engaging the means for converting kinetic energy from the energy storage to potential energy in the energy storage means and means for converting potential energy in the energy storage means to kinetic energy.

7. A method of continually lowering pipe in a well drilling, maintenance or repair operation, comprising;

a.) providing a system comprising: at least two lifting and lowering device pairs, each having a top section and bottom section, and capable an extended and contracted configuration and which are vertically disposed beside a well bore; a holding device and a rotating device connected to the top section of each lifting and lowering device; a power source to actuate the lifting and lowering devices, a pivoting device, the holding device and the rotating device connected to each lifting and lowering device; a transfer device to remove or introduce pipe; means to transfer power to the above devices; and an energy storage means;

b.) placing a first pipe section vertically above a well bore;

c.) activating the holding devices of a first pair of lifting and lowering devices in an extended configuration to engage the pipe placed above the well bore;

d.) causing the lifting and lowering devices of b.) to move to a contracted position, thus lowering the attached pipe and activating rotating devices and activation the rotating devices to cause threaded sections of the pipe to connect to a threaded coupling.

8. The method of claim 7 comprising;

e.) placing a second pipe section vertically above a well bore;

f.) activating the holding devices of a second pair of lifting and lowering devices in an extended configuration to engage the pipe placed above the well bore;

g.) causing the lifting and lowering devices of f.) to move to a contracted position, thus lowering the attached second pipe and activating rotating devices and activating the rotating devices to cause threaded sections of the pipe to connect to a threaded coupling attached to the first pipe.

9. The method of claim 7 comprising means for converting kinetic energy from the storage means to potential energy in the energy storage means; and means for converting potential energy from the energy storage means to kinetic energy to power the lifting and lowering device(s); the pivoting device(s); the holding device(s); the rotating device(s) and other associated devices.

10. The method of claim 7 in which each of the lifting and lowering devices comprise a hydraulic cylinder and piston.

11. The method of claim 9 in which the means for converting kinetic energy from the storage means to potential energy comprises transfer of hydraulic fluid from a storage means to the cylinder of a lifting and lowering device and transfer of hydraulic fluid from a lifting and lowering devices to the said storage means.

12. A method of continually lifting a pipe in a well drilling, maintenance or repair operation, comprising;

a.) providing a system comprising: at least two lifting and lowering device pairs, each having a top section and bottom section, and capable an extended and contracted configuration and which are vertically disposed beside a well bore; a holding device and a rotating device connected to the top section of each lifting and lowering device; a power source to actuate the lifting and lowering devices, a pivoting device, the holding device and the rotating device connected to each lifting and lowering device; a transfer device to remove or introduce pipe; means to transfer power to the above devices; and an energy storage means;

b.) placing a pipe section vertically above a well bore;

c.) activating the holding devices of one pair of lifting and lowering devices in a contracted configuration to engage the pipe placed above the well bore;

d.) causing the lifting and lowering devices of b.) to move to an extended position, thus raising the attached pipe and activating rotating devices and activating the rotating devices to cause threaded sections of the pipe to connect to a threaded coupling.

13. The method of claim 12 comprising;

e.) placing a second pipe section vertically above a well bore;

f.) activating the holding devices of a second pair of lifting and lowering devices in an extended configuration to engage the pipe placed above the well bore;

g.) causing the lifting and lowering devices of f.) to move to an expanded position, thus raising the attached second pipe and activating rotating devices and activating the rotating devices to cause threaded sections of the pipe to connect to a threaded coupling attached to the first pipe.

14. The method of claim 12 comprising means for converting kinetic energy from the storage means to potential energy in the energy storage means; and means for converting potential energy from the energy storage means to kinetic energy to power the lifting and lowering device(s); the pivoting device(s); the holding device(s); the rotating device(s) and other associated devices.

15. The method of claim 12 in which each of the lifting and lowering devices comprise a hydraulic cylinder and piston.

16. The method of claim 14 in which the means for converting kinetic energy from the storage means to potential energy comprises transfer of hydraulic fluid from a storage means to the cylinder of a lifting and lowering device and transfer of hydraulic fluid from a lifting and lowering devices to the said storage means.

* * * * *